US005167555A

United States Patent [19]

Tanba

[11] Patent Number: 5,167,555

[45] Date of Patent: Dec. 1, 1992

[54] METHOD AND APPARATUS FOR MANUFACTURE OF CATHODE-RAY TUBE

[75] Inventor: Kiyotaka Tanba, Inazawa, Japan

[73] Assignee: Sony Corporation, Tokyo, Japan

[21] Appl. No.: 581,550

[22] Filed: Sep. 12, 1990

[30] Foreign Application Priority Data

Sep. 14, 1989 [JP] Japan ..... 1-238739

[51] Int. Cl.[5] ..... H01J 9/38

[52] U.S. Cl. ..... 445/19; 445/6; 445/55

[58] Field of Search ..... 445/5, 19, 6, 36, 55, 445/57, 70, 73

[56] References Cited

U.S. PATENT DOCUMENTS

| | | | |
|---|---|---|---|
| 1,929,212 | 10/1933 | O'Neill | 445/57 |
| 2,004,646 | 6/1935 | Becker | 445/57 |
| 3,698,786 | 10/1972 | Gronka | 445/6 |
| 4,131,824 | 12/1978 | Nakai et al. | 333/185 |
| 4,410,310 | 10/1983 | Halbrook | 445/57 |

FOREIGN PATENT DOCUMENTS

| | | | |
|---|---|---|---|
| 0232635 | 11/1985 | Japan | 445/36 |

OTHER PUBLICATIONS

H. Armagnat, *The Theory, Design, and Construction of Induction Coils,* Transl. by O. A. Kenyon, McGraw, N.Y., 1908, pp. 49–56.

*Primary Examiner*—Richard K. Seidel
*Assistant Examiner*—Jeffrey T. Knapp
*Attorney, Agent, or Firm*—Hill, Van Santen, Steadman & Simpson

[57] ABSTRACT

A method and an apparatus for manufacture of a cathode-ray tube where an electron gun for emitting a plurality of electron beams is enclosed in a tube body with discrete electrodes disposed individually to such beams and joint electrodes disposed commonly to the beams. The method comprises the steps of incorporating the electron gun in the tube body and applying high-frequency induction heat principally to the joint electrodes to thereby evacuate and seal up the tube body; flashing a getter material; and disposing at least a pair of cored coils on both sides of the tube body at positions opposite to the discrete electrodes disposed individually to the plurality of beams, and applying high-frequency induction heat principally to the discrete electrodes. Meanwhile, the apparatus is equipped with a high-frequency induction heating device having a pair of cored coils to execute the electron gun heating with certainty, hence realizing satisfactory manufacture of a high-reliability cathode-ray tube having a long service life.

1 Claim, 3 Drawing Sheets

METHOD AND APPARATUS FOR MANUFACTURE OF CATHODE-RAY TUBE

BACKGROUND OF THE INVENTION

1. Field of the Invention

The present invention relates to a method and an apparatus for manufacture of a cathode-ray tube, and more particularly to an apparatus and method concerned with an electron gun heating technique required during evacuation of a tube body in the process of manufacturing a cathode-ray tube.

2. Description of the Prior Art

In manufacture of a cathode-ray tube, it is necessary to evacuate the same to a high vacuum degree. Therefore, as disclosed in Japanese Utility model Publication No. 61 (1986)-15585 for example, an electron gun is heated to a high temperature in the process of evacuating the tube body so that the entire complement of electrodes of the electron gun are degassed with positive removal of any extraneous substances therefrom to consequently achieve complete evacuation.

For the purpose of further raising the vacuum degree in the tube after such gun heating step, it is customary to flash a getter material by heating a getter container so as to adsorb any residual gases in the tube body.

In evacuating a cathode-ray tube during the manufacture thereof as illustrated in FIG. 1, an electron gun 2 is disposed in a neck portion of a tube body 1 of the cathode-ray tube. In the electron gun 2, for example, three cathodes Kl, K2, K3 for emitting three electron beams therefrom are arranged on a horizontal line as viewed from a fluorescent screen (not shown) provided on the front of the cathode-ray tube or opposite to the electron gun 2. Cup-shaped grid electrodes G11, G12, G13 of a first grid electrode G1 are disposed respectively opposite to the discrete cathodes K1, K2, K3. Meanwhile a second grid electrode G2, a third grid electrode G3, a fourth grid electrode G4 and a fifth grid electrode G5 are arranged in common to the grid electrodes G11, G12, G13 concentrically with the center cathode K2 and the first grid electrode G12. And in a stage posterior to the fifth grid G5, a convergence means C is disposed for converging the three electron beams from the cathodes K1, K2, K3 onto the fluorescent screen. A getter container 4 is provided at the fore end of the convergence means C, which is located in front of the electron gun 2, via a spring 3 in such a manner as to be positioned outside the paths of electron beams. On the inner surface of a funnel portion of the tube body 1, there is deposited an internal conductor film 5 to which a high voltage (anode voltage) is applied, and free ends of a plurality of conductive springs 6 provided at the distal end of the electron gun 2 are arranged around the axis of the electron gun 2 and are resiliently kept in contact with the conductor film 5. The high voltage applied via such conductive springs 6 to the internal conductor film 5 is supplied as a fixed voltage to both the first grid electrode G5 and the third grid electrode G3 connected electrically thereto, and also to the convergence means C. The electron gun 2 is disposed concentrically with the axis of the neck portion of the tube body 1 by means of such conductive springs 6.

Denoted by 7 is a beading glass member for holding the individual electrodes in a predetermined positional relationship to one another. More specifically, the discrete electrodes G11, G12, G13 of the first grid electrode G1 are mechanically interconnected, although not shown, and are held in a predetermined positional relationship to the other electrode, i.e., the second grid electrode G2 by the beading glass member 7. The electron gun 2 has a stem 8 welded to an end of the neck portion of the tube body 1, and lead pins for the electrodes, other than those to which the aforementioned high voltage is applied, are connected to a plurality of terminal pins 9 so provided as to pierce through the stem 8, whereby such other electrodes are electrically energized while being mechanically retained by cooperation with the conductive springs 6.

Evacuation of the tube body 1 is executed via a chip-off pipe 10 so provided as to pierce through the stem 8, and after completion of the evacuation, the pipe 10 is made molten and chipped off by the application of heat thereto to consequently seal up the tube body 1.

For such evacuation, a heating means 11 consisting of a high-frequency induction heating coil is disposed opposite to the periphery of the electron gun 2 as illustrated in FIG. 1, and a high-frequency voltage in a frequency range of 350 to 400 kHz is applied to the heating means 11 so that an induced current is caused to flow in each electrode of the electron gun 2, thereby heating the electrodes. In this case, when heating is executed at a required temperature with regard to the electrodes provided in common to the cathodes K1, K2, K3, i.e., the second through fifth grids G2–G5 within a temperature range of 700° to 750° C. adequate for effectively degassing such electrodes, then the small-diameter grids G11, G12, G13 provided individually with respect to the cathodes K1, K2, K3 fail to be sufficiently heated as the temperature thereof is 600° C. or so, and therefore complete degassing is not achieved. Meanwhile, if the condition is such that the small-diameter grids G11, G12, G13 are heated at a required temperature ranging from 700° to 750° C. for example, then the other electrodes G2-G5 are heated excessively beyond the limit to raise a problem of metal evaporation. Therefore it is customary to carry out the gun heating step in such a manner that the large-diameter common electrodes are heated up to a predetermined temperature of 700° to 750° C. And thereafter the pipe 10 is chipped off to seal up the tube body. Posterior to such evacuation and seal-up, the getter container 4 is similarly heated by the high-frequency induction heating means to execute the getter flashing step as mentioned already, and then the aging step is executed to maintain emission of thermoelectrons from the cathodes of the cathode-ray tube.

However, according to the method described above, the discrete electrodes G11, G12, G13 provided individually to the electron beams are not heated sufficiently, so that complete stabilization is not attainable by the subsequent aging step to eventually bring about characteristic variation, hence causing an impediment to a long service life of the product.

In case the electrodes G11, G12, G13 are provided individually with respect to the electron beams as mentioned, tiny-diameter holes for passing the electron beams therethrough are formed in the electrodes respectively, so that during the operation, impingement of the electrons from the cathodes K1, K2, K3 is great upon the electrodes G11, G12, G13. Therefore, incomplete degassing with regard to the electrodes G11, G12, G13 exerts considerably harmful influence on the desired stable operation and long service life. Furthermore, after the cathode-ray tube is sealed up, the aging is executed as described above to keep emission of thermoelectrons from the cathodes for attaining activation and stabilization of the tube. Degassing the electrons is effected to a certain extent also by the impingement of the electrons emitted in the aging step, and the gases thus removed are adsorbed into the flashed getter material to attain a stabilized state. However, since the beam passage holes formed in the electrodes G11, G12, G13 are tiny in diameter, sufficient degassing is not achieved during the normal aging time. Therefore, the residual gases are released in the operation of the cathode-ray tube after completion as a product to consequently bring about some disadvantages relative to deterioration of the thermoelectron emission characteristics of the cathodes inclusive of slumping and failure in proper emission conforming with cutoff, hence shortening the service life of the cathode-ray tube as a result.

OBJECTS AND SUMMARY OF THE INVENTION

In manufacture of a cathode-ray tube employing an electron gun with discrete electrodes disposed individually with respect to a plurality of electron beams as mentioned, an object of the present invention is to provide an improved method suited for solution of the problems including characteristic deterioration and service-life reduction that may be derived from incomplete degassing of such discrete electrodes.

And another object of the present invention is to provide an improved apparatus adapted for carrying out such cathode-ray tube manufacturing method to attain excellent emission characteristics and a prolonged service life.

According to one aspect of the present invention, there is provided a method for manufacture of a cathode ray tube where an electron gun for emitting a plurality of electron beams is enclosed in a tube body with discrete electrodes disposed individually with respect to such beams and joint electrodes disposed commonly to the beams. The method comprises a step of incorporating the electron gun in the tube body and applying high-frequency induction heat principally to the joint electrodes to thereby evacuate and seal up the tube body; a step of flashing a getter material; and a step of disposing at least a pair of cored coils on both sides of the tube body at positions opposite to the discrete electrodes disposed individually to the plurality of beams, and applying high-frequency induction heat principally to the discrete electrodes.

According to another aspect of the present invention, there is provided an apparatus for manufacture of the cathode-ray tube mentioned, wherein at least a pair of cored coils are disposed on both sides of the tube body at positions opposite to the discrete electrodes, and high-frequency induction heat is applied principally to the discrete electrodes.

Due to the induction heating effected by the cored coils, magnetic fluxes can be sufficiently concentrated even with regard to the small-diameter electrodes which are provided individually to a plurality of electron beams. Therefore, efficient high-frequency induction heating can be performed in a required degassing temperature range of 700° to 750° C., and the residual gases can be adsorbed into the flashed getter material to consequently attain stabilized characteristics and a long service life of the cathode-ray tube.

The above and other features of the present invention will be apparent in detail from the following description which will be given with reference to the illustrative accompanying drawings.

DESCRIPTION OF THE PREFERRED EMBODIMENTS

A cathode-ray tube manufacturing method of the present invention and an exemplary apparatus for carrying out such method will be described in detail below with reference to the accompanying drawings.

Figure 1:
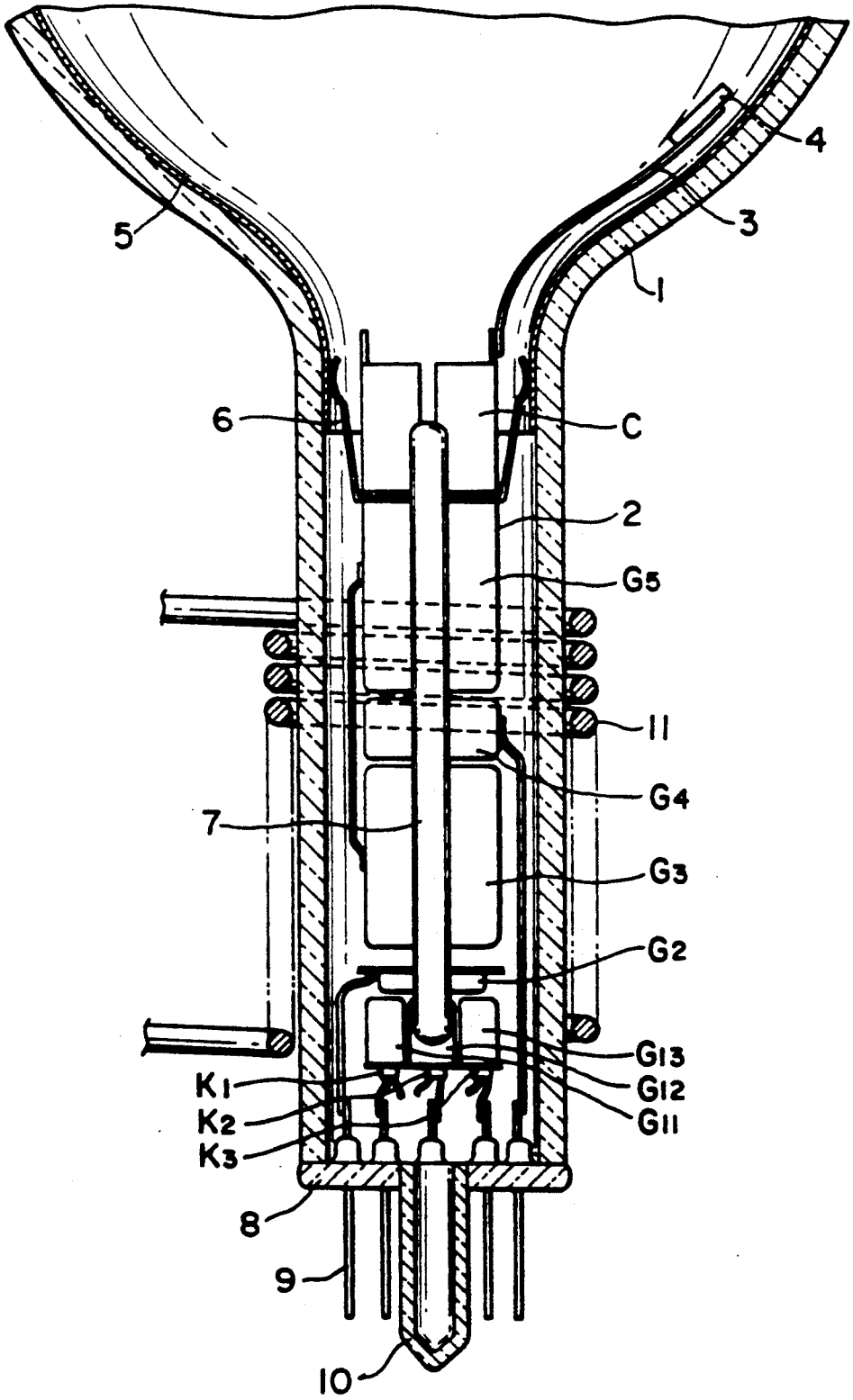
FIG. 1 is a partially sectional side view of principal components in one step of the cathode-ray tube manufacturing method of the present invention.
Figure 2:
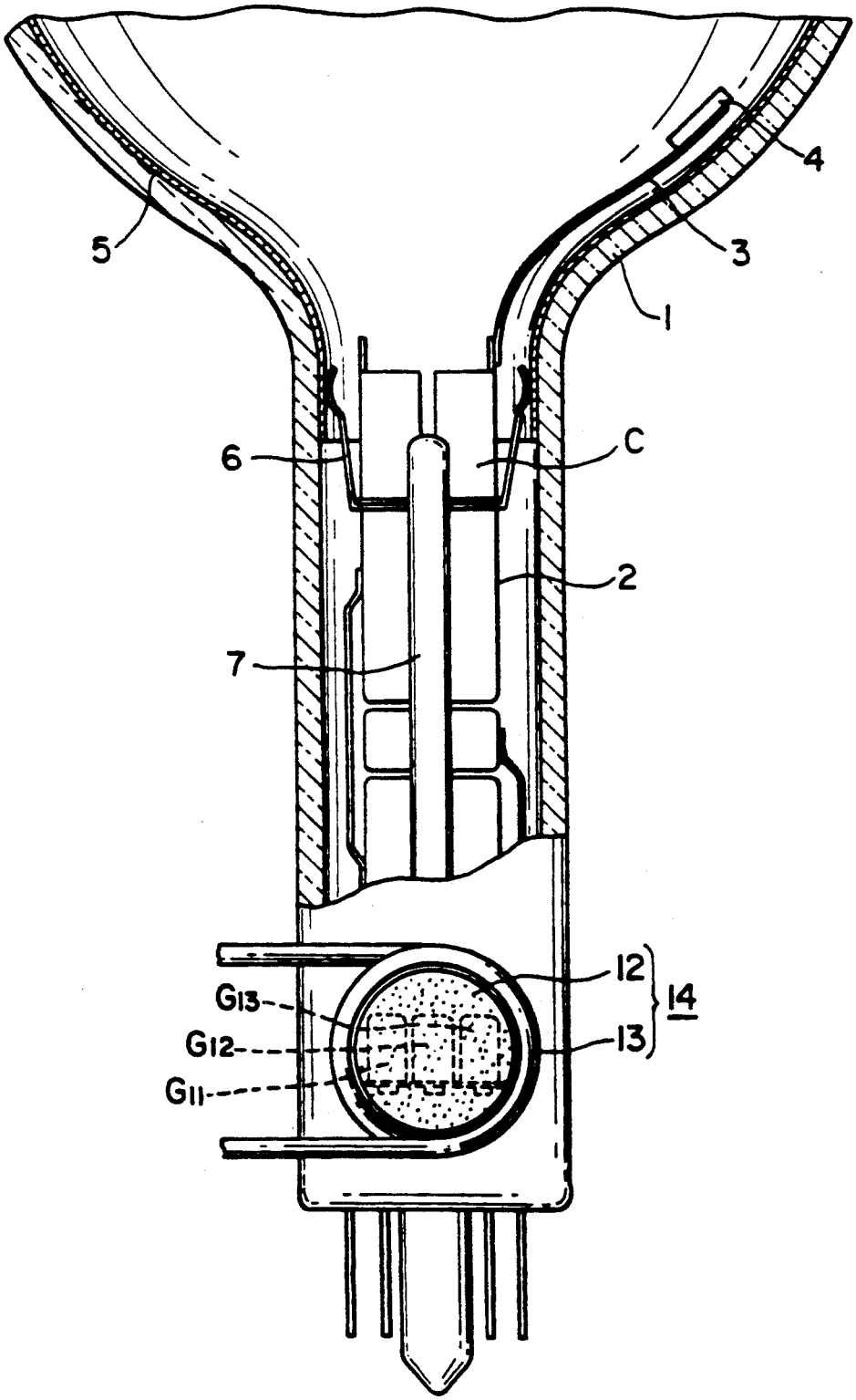
FIG. 2 is a partially sectional side view of principal components in another step of such method.
Figure 3:
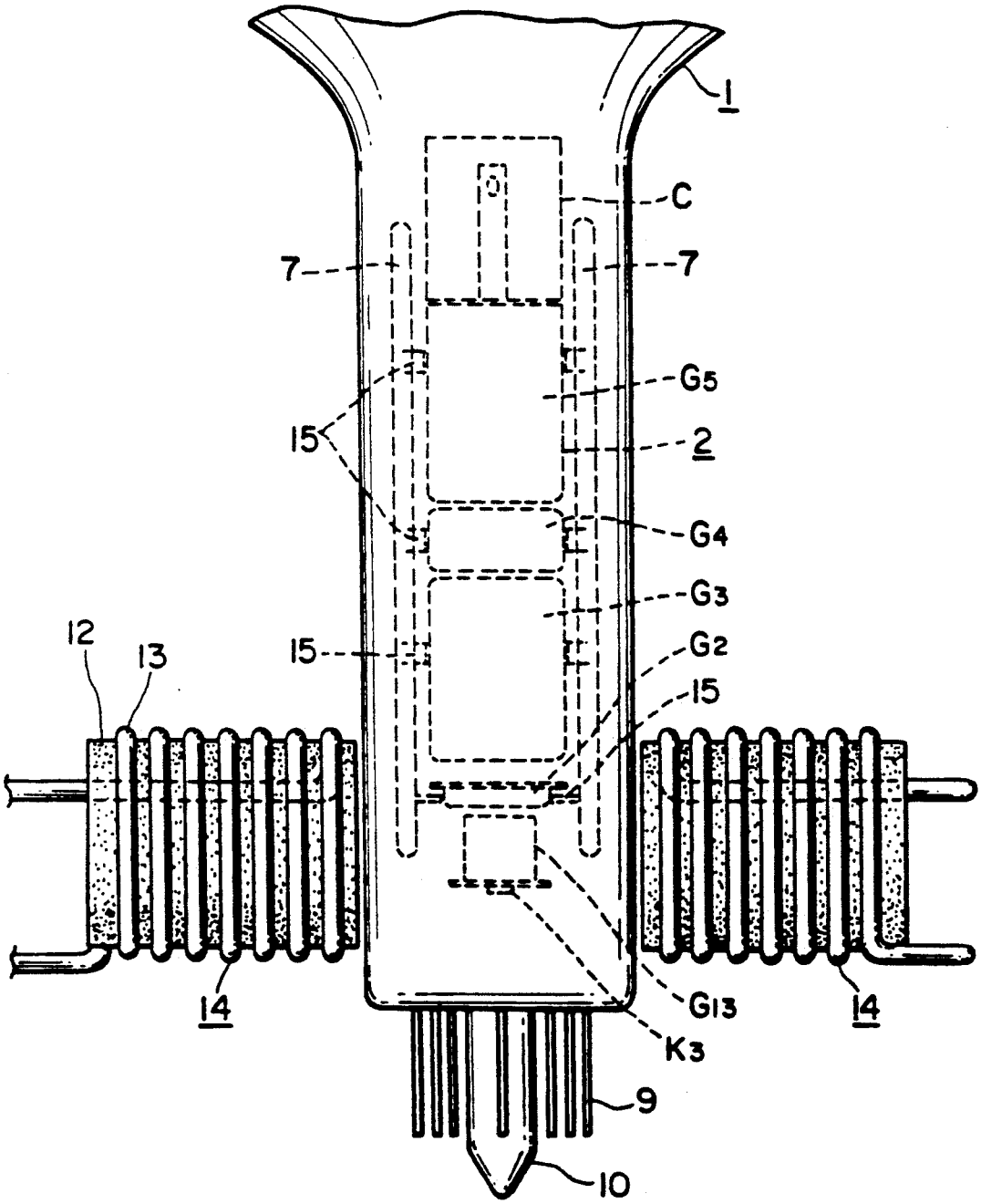
FIG. 3 is a reverse side view in the step of FIG. 2.

FIGS. 1 and 2 are partially sectional side views illustrating principal components of a cathode-ray tube in respective steps of the method of the present invention, and FIG. 3 is another side view seen from the reverse side of FIG. 2.

An electron gun 2 is disposed on the axis of a neck portion of a cathode-ray tube body 1. In the electron gun 2, three cathodes K1, K2, K3 for emitting electron beams are arranged in such a manner that the respective cathode surfaces thereof are positioned on a horizontal straight line as viewed from a fluorescent surface (not shown) positioned opposite to the electron gun 2. And first grid electrodes G11, G12, G13 are disposed correspondingly to such three cathodes K1, K2, K3. The electrodes G11, G12, G13 are cup-shaped with end face plates where tiny holes for passing electron beams therethrough are formed, although not shown, opposite to beam emission surfaces (thermoelectron release surfaces) of the cathodes K1, K2, K3. Meanwhile a second grid electrode G2, a third grid electrode G3, a fourth grid electrode G4 and a fifth grid electrode G5 are arranged in common to the three electron beams coaxially with the center cathode K2 and the first grid electrode G12, i.e., on the axis of the neck portion of the tube body 1, and a convergence means C is disposed at the fore ends of such grid electrodes. Furthermore, a getter container 4 such as a ring-shaped metallic container having a getter material therein is attached via a spring 3 to the distal end of the electron gun 2.

Conductive springs 6 are disposed at the distal end of the electron gun 2, and free ends thereof are resiliently kept in contact with an internal conductor film 5 which is formed on the inner surface of a funnel portion of the tube body 1 and to which a high voltage (anode voltage) is applied, whereby the electron gun 2 is positioned on the axis of the neck portion of the tube body 1. In such a structure, a high voltage is applied to the convergence means C of the electron gun 2, the fifth grid electrode G5 and also to the third grid electrode G3 connected thereto electrically via a lead.

A glass stem 8 is disposed in a base region of the electron gun 2, and a chip-off pipe 10 is positioned substantially at the center of the glass stem 8 in a manner to pierce therethrough. And a plurality of ring-shaped terminal pins 9 are arranged around the pipe 10. In this structure, the cathodes K1, K2, K3 and a heater disposed therein are electrically energized, and simultaneously power is supplied to the first grid electrodes G11, G12, G13 and also to the second grid G2 and the fourth grid G4 while the electron gun 2 is mechanically held. The electrodes G11, G12, G13 are mechanically connected with one another although not shown, and are retained to a beading glass member 7 by means of support pins. Also the third through fifth grid electrodes G2–G5 are retained to the beading glass member 7 by means of support pins 15, as illustrated in FIG. 3, while being held in a predetermined positional relationship to one another.

In the present invention, a first gun heating step is executed in a state where the pipe 10 is not chipped off with its outer end left open and connected to a vacuum pump for evacuating the tube body. In this step, a high-frequency induction heating device 11 is so disposed that its high-frequency coil is wound around the periphery of the neck portion of the tube body 1, i.e., around the periphery of the electron gun 2, and is energized by a voltage of 350 to 400 kHz to thereby heat and degas principally the common second through fifth grid electrodes G2–G5 in a temperature range of 700° to 750° C. by high-frequency induction heating. Thereafter a heater (not shown) in the cathodes K1–K3 is energized to heat such cathodes at 900° C. for 20 seconds or so, thereby decomposing and activating the cathode material. The tube body 1 thus evacuated is then sealed up by heating and melting a portion of the chip-off pipe 10.

Subsequently the getter container 4 is heated by high-frequency induction heating or the like to execute a getter flashing step which flashes the getter material in the container.

Then, a second gun heating step is executed in particular by the use of a special gun heating device peculiar to the present invention. The gun heating device contrived to execute such second gun heating step is so constituted that, as illustrated in FIGS. 2 and 3, a pair of cored coils 14 are disposed outside the neck portion of the cathode-ray tube body 1 and on both sides of the first grids G11, G12, G13 provided individually with respect to the beams of the electron gun 2.

The cored coils 14 have a selected diameter and a predetermined positional relationship so that, as illustrated in FIG. 2, columnar cores 12 composed of a high-permeability material such as ferrite are opposed to the entirety of the three electrodes G11, G12, G13 laterally thereof, and also that the respective end faces of the paired cores 12 are opposed to each other. A high-frequency coil 13 is wound on each core 12, and a voltage of, e.g., 350 to 400 kHz is applied thereto. The winding directions of the coils and the energizing directions thereto are selectively determined to attain such a relationship that magnetic fields are generated in the same direction with respect to the first grid electrodes G11, G12, G13 and the respective magnetic fluxes obtained from the pair of cored coils 14 do not cancel each other. Thus, the magnetic fluxes generated from the coils 14 are applied in the same direction to the electrodes G11, G12, G13, which are thereby heated to be degassed by induction heating in a temperature range of 700° to 750° C. The gun heating step is executed in this manner, and the removed gases are adsorbed into the getter material.

Thereafter, as in the ordinary process, an aging step is executed to keep the cathodes K1, K2, K3 in a state where thermoelectrons are released therefrom, and free barium or the like released from the cathode material is extracted from the grid electrodes G11, G12, G13, G2 and so forth while the cathode material is stabilized.

In the cathode-ray tube obtained after execution of such second gun heating step with the cored coils 14, it has been confirmed that excellent emission characteristics of the cathodes are ensured with elimination of slumping, and adequate emission is achieved in conformity with the cutoff, whereby stable characteristics can be maintained in a long term.

Table 1 below shows the results of evaluation acquired with regard to one electron gun (hereinafter referred to as electron gun A) where a first grid electrode G1 through a fifth grid electrode G5 are provided in common to a plurality of beams, and another electron gun (hereinafter referred to as electron gun B) in the present invention where, as described in connection with FIGS. 1 through 3, first grid electrodes G11, G12, G13 having electron-beam passage holes are disposed individually in respect to cathodes from which electron beams are emitted. In this table, symbols "o" represent a case with execution of the steps such as first gun heating, decomposition and activation of the cathodes, evacuation and seal up, getter flashing, and second gun heating; whereas symbols "x" represent another case without execution of such steps. Regarding the emission characteristics of the cathodes inclusive of the slumping and the emission conforming with the cutoff, each symbol "o" denotes a satisfactory result of evaluation while each symbol "x" denotes an unsatisfactory result.

TABLE 1

| | First gun heating | Decomp. and activ. of cathodes | Evac. and seal up | Getter flash | Second gun heating | Evaluation |
|---|---|---|---|---|---|---|
| Elec. Gun A | o | o | o | o | x | o |
| Elec. Gun B | x | x | o | o | o | o |
| | x | x | o | o | o | x |
| | o | o | o | o | o | o |

As is obvious from Table 1 above, when the first and second gun heating steps are both executed as in the present invention, there is producible an improved cathode-ray tube having excellent emission characteristics even with the electron gun B where the electron-beam passage holes are extremely small.

The embodiment mentioned is concerned with an exemplary case of applying the present invention to a cathode-ray tube where merely first grids alone are provided individually with respect to a plurality of beams. However, it is to be understood that the present invention is applicable also to a modified constitution where discrete second grids and so forth are disposed individually with respect to a plurality of beams, and further to another cathode-ray tube where a different electron gun structure is employed besides the aforementioned one with first through fifth grids.

According to the present invention, as described hereinabove, particularly a second gun heating step is executed, in addition to an ordinary first gun heating step, for the tube portion with a plurality of discrete electrodes by the use of a heating means having cored coils, thereby carrying out proper heat treatments individually to achieve sufficient degassing. Therefore, even when the structure is such that the first grid electrodes G11, G12, G13 have tiny-diameter electron beam passage holes opposite to the respective thermoelectron emission surfaces of the cathodes, it becomes possible to effectively avert characteristic deterioration and service life reduction that may otherwise be derived from release of any residual gases caused by impingement of thermoelectrons upon such electrodes Gll, G12, G13.

What is claimed is:

1. A method for manufacture of a cathode-ray tube where an electron gun for emitting a plurality of electron beams is enclosed in a tube body with discrete electrodes disposed individually to said beams and joint electrodes disposed commonly to said beams, said method comprising:

the steps of incorporating said electron gun in the tube body;

applying high-frequency induction heat principally to said joint electrodes to thereby evacuate and seal up said tube body;

flashing a getter material; and disposing at least a pair of cored coils on both sides of said tube body at positions opposite to said discrete electrodes disposed individually to said plurality of beams, and after said flashing, applying high-frequency electric current to said cored coils, whereby induction heat is applied principally to said discrete electrodes.

* * * * *